US009151258B2

(12) United States Patent
McAlister

(10) Patent No.: US 9,151,258 B2
(45) **Date of Patent: *Oct. 6, 2015**

(54) INTEGRATED FUEL INJECTOR IGNITERS HAVING FORCE GENERATING ASSEMBLIES FOR INJECTING AND IGNITING FUEL AND ASSOCIATED METHODS OF USE AND MANUFACTURE

(71) Applicant: McAlister Technologies, LLC, Phoenix, AZ (US)

(72) Inventor: Roy Edward McAlister, Phoenix, AZ (US)

(73) Assignee: McAlister Technologies, Inc., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/060,210

(22) Filed: Oct. 22, 2013

(65) Prior Publication Data

US 2014/0230779 A1 Aug. 21, 2014

Related U.S. Application Data

(63) Continuation of application No. 13/347,603, filed on Jan. 10, 2012, now Pat. No. 8,561,591, which is a continuation of application No. 12/961,453, filed on Dec. 6, 2010, now Pat. No. 8,091,528.

(51) Int. Cl.
*F02M 57/06* (2006.01)

(52) U.S. Cl.
CPC ..... *F02M 57/06* (2013.01)

(58) Field of Classification Search
CPC ..... F02M 57/06
USPC ..... 123/297, 634, 635; 313/120
See application file for complete search history.

(56) References Cited

U.S. PATENT DOCUMENTS 1,451,384 A 4/1923 Whyte
1,765,237 A 6/1930 King (Continued)

FOREIGN PATENT DOCUMENTS

DE 3443022 A1 5/1986
DE 10011711 A1 10/2001

(Continued)

OTHER PUBLICATIONS

"P dV's Custom Data Acquisition Systems Capabilities." PdV Consulting. Accessed: Jun. 28, 2010. Printed: May 16, 2011. <http://www.pdvconsult.com/capabilities%20-%20daqsys.html>. pp. 1-10.

(Continued)

*Primary Examiner* — Erick Solis
(74) *Attorney, Agent, or Firm* — Perkins Coie LLP

(57) ABSTRACT

Embodiments of injectors configured for adaptively injecting and igniting various fuels in a combustion chamber are disclosed herein. An injector according to one embodiment includes an end portion configured to be positioned adjacent to a combustion chamber, and an ignition feature carried by the end portion and configured to generate an ignition event. The injector also includes a force generator assembly and a movable valve. The force generator assembly includes a first force generator separate from a second force generator. The first force generator creates a motive force to move the valve between the closed and open positions into the combustion chamber. The second force generator is electrically coupled to the ignition feature and provides voltage to the ignition feature to at least partially generate the ignition event.

20 Claims, 2 Drawing Sheets

(56) References Cited

U.S. PATENT DOCUMENTS

| | | | |
|---|---|---|---|
| 2,255,203 | A | 9/1941 | Wiegand |
| 2,441,277 | A | 5/1948 | Lamphere |
| 3,058,453 | A | 10/1962 | May |
| 3,060,912 | A | 10/1962 | May |
| 3,081,758 | A | 3/1963 | May |
| 3,243,335 | A | 3/1966 | Faile |
| 3,373,724 | A | 3/1968 | Papst |
| 3,520,961 | A | 7/1970 | Suda et al. |
| 3,594,877 | A | 7/1971 | Suda et al. |
| 3,608,050 | A | 9/1971 | Carman et al. |
| 3,689,293 | A | 9/1972 | Beall |
| 3,926,169 | A | 12/1975 | Leshner et al. |
| 3,931,438 | A | 1/1976 | Beall et al. |
| 3,960,995 | A | 6/1976 | Kourkene |
| 3,976,039 | A | 8/1976 | Henault |
| 3,997,352 | A | 12/1976 | Beall |
| 4,066,046 | A | 1/1978 | McAlister |
| 4,095,580 | A | 6/1978 | Murray et al. |
| 4,122,816 | A | 10/1978 | Fitzgerald et al. |
| 4,135,481 | A | 1/1979 | Resler, Jr. |
| 4,203,393 | A | 5/1980 | Giardini |
| 4,295,453 | A | 10/1981 | Seilly et al. |
| 4,330,732 | A | 5/1982 | Lowther |
| 4,332,223 | A | 6/1982 | Dalton |
| 4,342,443 | A | 8/1982 | Wakeman |
| 4,351,299 | A | 9/1982 | Costello |
| 4,364,342 | A | 12/1982 | Asik |
| 4,377,455 | A | 3/1983 | Kadija et al. |
| 4,469,160 | A | 9/1984 | Giamei |
| 4,483,485 | A | 11/1984 | Kamiya et al. |
| 4,511,612 | A | 4/1985 | Huther et al. |
| 4,528,270 | A | 7/1985 | Matsunaga |
| 4,536,452 | A | 8/1985 | Stempin et al. |
| 4,567,857 | A | 2/1986 | Houseman et al. |
| 4,574,037 | A | 3/1986 | Samejima et al. |
| 4,677,960 | A | 7/1987 | Ward |
| 4,688,538 | A | 8/1987 | Ward et al. |
| 4,733,646 | A | 3/1988 | Iwasaki |
| 4,736,718 | A | 4/1988 | Linder |
| 4,742,265 | A | 5/1988 | Giachino et al. |
| 4,760,818 | A | 8/1988 | Brooks et al. |
| 4,760,820 | A | 8/1988 | Tozzi |
| 4,774,914 | A | 10/1988 | Ward |
| 4,774,919 | A | 10/1988 | Matsuo et al. |
| 4,777,925 | A | 10/1988 | LaSota |
| 4,841,925 | A | 6/1989 | Ward |
| 4,922,883 | A | 5/1990 | Iwasaki |
| 4,967,708 | A | 11/1990 | Linder et al. |
| 4,972,996 | A | 11/1990 | Cerny |
| 4,977,873 | A | 12/1990 | Cherry et al. |
| 4,982,708 | A | 1/1991 | Stutzenberger |
| 5,034,852 | A | 7/1991 | Rosenberg |
| 5,055,435 | A | 10/1991 | Hamanaka et al. |
| 5,056,496 | A | 10/1991 | Morino et al. |
| 5,076,223 | A | 12/1991 | Harden et al. |
| 5,095,742 | A | 3/1992 | James et al. |
| 5,107,673 | A | 4/1992 | Sato et al. |
| 5,109,817 | A | 5/1992 | Cherry |
| 5,131,376 | A | 7/1992 | Ward et al. |
| 5,193,515 | A | 3/1993 | Oota et al. |
| 5,207,208 | A | 5/1993 | Ward |
| 5,211,142 | A | 5/1993 | Matthews et al. |
| 5,220,901 | A | 6/1993 | Morita et al. |
| 5,267,601 | A | 12/1993 | Dwivedi |
| 5,297,518 | A | 3/1994 | Cherry |
| 5,305,360 | A | 4/1994 | Remark et al. |
| 5,328,094 | A | 7/1994 | Goetzke et al. |
| 5,377,633 | A | 1/1995 | Wakeman |
| 5,392,745 | A | 2/1995 | Beck |
| 5,421,299 | A | 6/1995 | Cherry |
| 5,435,286 | A | 7/1995 | Carroll, III et al. |
| 5,439,532 | A | 8/1995 | Fraas |
| 5,456,241 | A | 10/1995 | Ward |
| 5,475,772 | A | 12/1995 | Hung et al. |
| 5,497,744 | A | 3/1996 | Nagaosa et al. |
| 5,517,961 | A | 5/1996 | Ward |
| 5,531,199 | A | 7/1996 | Bryant et al. |
| 5,549,746 | A | 8/1996 | Scott et al. |
| 5,584,490 | A | 12/1996 | Inoue et al. |
| 5,588,299 | A | 12/1996 | DeFreitas |
| 5,605,125 | A | 2/1997 | Yaoita |
| 5,607,106 | A | 3/1997 | Bentz et al. |
| 5,676,026 | A | 10/1997 | Tsuboi et al. |
| 5,699,253 | A | 12/1997 | Puskorius et al. |
| 5,702,761 | A | 12/1997 | DiChiara, Jr. et al. |
| 5,704,321 | A | 1/1998 | Suckewer et al. |
| 5,715,788 | A | 2/1998 | Tarr et al. |
| 5,738,818 | A | 4/1998 | Atmur et al. |
| 5,746,171 | A | 5/1998 | Yaoita |
| 5,767,026 | A | 6/1998 | Kondoh et al. |
| 5,797,427 | A | 8/1998 | Buescher |
| 5,806,581 | A | 9/1998 | Haasch et al. |
| 5,853,175 | A | 12/1998 | Udagawa |
| 5,863,326 | A | 1/1999 | Nause et al. |
| 5,876,659 | A | 3/1999 | Yasutomi et al. |
| 5,915,272 | A | 6/1999 | Foley et al. |
| 5,941,207 | A | 8/1999 | Anderson et al. |
| 6,017,390 | A | 1/2000 | Charych et al. |
| 6,026,568 | A | 2/2000 | Atmur et al. |
| 6,036,120 | A | 3/2000 | Varble et al. |
| 6,062,498 | A | 5/2000 | Klopfer |
| 6,085,990 | A | 7/2000 | Augustin |
| 6,092,501 | A | 7/2000 | Matayoshi et al. |
| 6,092,507 | A | 7/2000 | Bauer et al. |
| 6,093,338 | A | 7/2000 | Tani et al. |
| 6,102,303 | A | 8/2000 | Bright et al. |
| 6,138,639 | A | 10/2000 | Hiraya et al. |
| 6,173,913 | B1 | 1/2001 | Shafer et al. |
| 6,185,355 | B1 | 2/2001 | Hung |
| 6,189,522 | B1 | 2/2001 | Moriya |
| 6,209,805 | B1 | 4/2001 | Male et al. |
| 6,253,728 | B1 | 7/2001 | Matayoshi et al. |
| 6,267,307 | B1 | 7/2001 | Pontoppidan |
| 6,302,080 | B1 | 10/2001 | Kato et al. |
| 6,335,065 | B1 | 1/2002 | Steinlage et al. |
| 6,360,721 | B1 | 3/2002 | Schuricht et al. |
| 6,378,485 | B2 | 4/2002 | Elliott |
| 6,386,178 | B1 | 5/2002 | Rauch |
| 6,405,940 | B2 | 6/2002 | Harcombe et al. |
| 6,422,836 | B1 | 7/2002 | Krueger et al. |
| 6,453,660 | B1 | 9/2002 | Johnson et al. |
| 6,455,173 | B1 | 9/2002 | Marijnissen et al. |
| 6,478,007 | B2 | 11/2002 | Miyashita et al. |
| 6,502,555 | B1 | 1/2003 | Harcombe et al. |
| 6,506,336 | B1 | 1/2003 | Beall et al. |
| 6,517,011 | B1 | 2/2003 | Ayanji et al. |
| 6,532,315 | B1 | 3/2003 | Hung et al. |
| 6,550,458 | B2 | 4/2003 | Yamakado et al. |
| 6,567,599 | B2 | 5/2003 | Hung |
| 6,578,775 | B2 | 6/2003 | Hokao |
| 6,583,901 | B1 | 6/2003 | Hung |
| 6,584,244 | B2 | 6/2003 | Hung |
| 6,587,239 | B1 | 7/2003 | Hung |
| 6,615,899 | B1 | 9/2003 | Woodward et al. |
| 6,663,027 | B2 | 12/2003 | Jameson et al. |
| 6,672,277 | B2 | 1/2004 | Yasuoka et al. |
| 6,700,306 | B2 | 3/2004 | Nakamura et al. |
| 6,705,274 | B2 | 3/2004 | Kubo |
| 6,722,340 | B1 | 4/2004 | Sukegawa et al. |
| 6,722,840 | B2 | 4/2004 | Fujisawa et al. |
| 6,725,826 | B2 | 4/2004 | Esteghlal |
| 6,745,744 | B2 | 6/2004 | Suckewer et al. |
| 6,755,175 | B1 | 6/2004 | McKay et al. |
| 6,763,811 | B1 | 7/2004 | Tamol, Sr. |
| 6,832,588 | B2 | 12/2004 | Herden et al. |
| 6,845,920 | B2 | 1/2005 | Sato et al. |
| 6,851,413 | B1 | 2/2005 | Tamol, Sr. |
| 6,871,630 | B2 | 3/2005 | Herden et al. |
| 6,883,490 | B2 | 4/2005 | Jayne |
| 6,892,971 | B2 | 5/2005 | Rieger et al. |
| 6,899,076 | B2 | 5/2005 | Funaki et al. |
| 6,904,893 | B2 | 6/2005 | Hotta et al. |
| 6,912,998 | B1 | 7/2005 | Rauznitz et al. |
| 6,925,983 | B2 | 8/2005 | Herden et al. |

(56) References Cited

U.S. PATENT DOCUMENTS

| | | | |
|---|---|---|---|
| 6,940,213 | B1 | 9/2005 | Heinz et al. |
| 6,955,154 | B1 | 10/2005 | Douglas |
| 6,964,263 | B2 | 11/2005 | Xi et al. |
| 6,976,683 | B2 | 12/2005 | Eckert et al. |
| 6,994,073 | B2 | 2/2006 | Tozzi et al. |
| 7,007,658 | B1 | 3/2006 | Cherry et al. |
| 7,007,661 | B2 | 3/2006 | Warlick |
| 7,013,863 | B2 | 3/2006 | Shiraishi et al. |
| 7,025,358 | B2 | 4/2006 | Ueta et al. |
| 7,032,845 | B2 | 4/2006 | Dantes et al. |
| 7,070,126 | B2 | 7/2006 | Shinogle |
| 7,073,480 | B2 | 7/2006 | Shiraishi et al. |
| 7,077,379 | B1 | 7/2006 | Taylor |
| 7,086,376 | B2 | 8/2006 | McKay |
| 7,104,246 | B1 | 9/2006 | Gagliano et al. |
| 7,104,250 | B1 | 9/2006 | Yi et al. |
| 7,121,253 | B2 | 10/2006 | Shiraishi et al. |
| 7,131,426 | B2 | 11/2006 | Ichinose et al. |
| 7,140,347 | B2 | 11/2006 | Suzuki et al. |
| 7,140,353 | B1 | 11/2006 | Rauznitz et al. |
| 7,201,136 | B2 | 4/2007 | McKay et al. |
| 7,228,840 | B2 | 6/2007 | Sukegawa et al. |
| 7,249,578 | B2 | 7/2007 | Fricke et al. |
| 7,255,290 | B2 | 8/2007 | Bright et al. |
| 7,278,392 | B2 | 10/2007 | Zillmer et al. |
| 7,418,940 | B1 | 9/2008 | Yi et al. |
| 7,481,043 | B2 | 1/2009 | Hirata et al. |
| 7,527,041 | B2 | 5/2009 | Wing et al. |
| 7,554,250 | B2 | 6/2009 | Kadotani et al. |
| 7,588,012 | B2 | 9/2009 | Gibson et al. |
| 7,625,531 | B1 | 12/2009 | Coates et al. |
| 7,626,315 | B2 | 12/2009 | Nagase |
| 7,650,873 | B2 | 1/2010 | Hofbauer et al. |
| 7,703,775 | B2 | 4/2010 | Matsushita et al. |
| 7,707,832 | B2 | 5/2010 | Commaret et al. |
| 7,714,483 | B2 | 5/2010 | Hess et al. |
| 7,728,489 | B2 | 6/2010 | Heinz et al. |
| 7,849,833 | B2 | 12/2010 | Toyoda |
| 7,918,212 | B2 | 4/2011 | Verdejo et al. |
| 7,963,458 | B2 | 6/2011 | McNichols et al. |
| 8,069,836 | B2 | 12/2011 | Ehresman |
| 8,091,528 | B2 | 1/2012 | McAlister |
| 8,239,114 | B2 | 8/2012 | Goeke et al. |
| 2002/0017573 | A1 | 2/2002 | Sturman |
| 2002/0084793 | A1 | 7/2002 | Hung et al. |
| 2002/0131171 | A1 | 9/2002 | Hung |
| 2002/0131666 | A1 | 9/2002 | Hung et al. |
| 2002/0131673 | A1 | 9/2002 | Hung |
| 2002/0131674 | A1 | 9/2002 | Hung |
| 2002/0131706 | A1 | 9/2002 | Hung |
| 2002/0131756 | A1 | 9/2002 | Hung |
| 2002/0141692 | A1 | 10/2002 | Hung |
| 2002/0150375 | A1 | 10/2002 | Hung et al. |
| 2002/0151113 | A1 | 10/2002 | Hung et al. |
| 2003/0127531 | A1 | 7/2003 | Hohl |
| 2004/0008989 | A1 | 1/2004 | Hung |
| 2005/0255011 | A1 | 11/2005 | Greathouse et al. |
| 2007/0189114 | A1 | 8/2007 | Reiner et al. |
| 2008/0072871 | A1 | 3/2008 | Vogel et al. |
| 2008/0098984 | A1 | 5/2008 | Sakamaki |
| 2009/0093951 | A1 | 4/2009 | McKay et al. |
| 2011/0056458 | A1 | 3/2011 | McAlister |
| 2011/0253104 | A1 | 10/2011 | McAlister |

FOREIGN PATENT DOCUMENTS

| | | | |
|---|---|---|---|
| DE | 10313859 | A1 | 12/2003 |
| FR | 2922964 | A1 | 5/2009 |
| GB | 1038490 | A | 8/1966 |
| JP | 6270656 | | 4/1987 |
| JP | 2061360 | | 1/1990 |
| JP | 2001512564 | A | 8/2001 |
| JP | 2003512554 | A | 4/2003 |
| JP | 2003525390 | A | 8/2003 |
| JP | 2007231929 | A | 9/2007 |
| WO | WO-2007031157 | A1 | 3/2007 |

OTHER PUBLICATIONS

"Piston Velocity and Acceleration." EPI, Inc. Accessed: Jun. 28, 2010. Printed: May 16, 2011. <http://www.epi-eng.com/piston_engine_technology/piston_velocity_and_acceleration.htm>. pp. 1-3.

"SmartPlugs—Aviation." SmartPlugs.com. Published: Sep. 2000. Accessed: May 31, 2011. <http://www.smartplugs.com/news/aeronews0900.htm>. pp. 1-3.

Birchenough, Arthur G. "A Sustained-arc Ignition System for Internal Combustion Engines." Nasa Technical Memorandum (NASA TM-73833). Lewis Research Center. Nov. 1977. pp. 1-15.

Doggett, William. "Measuring Internal Combustion Engine In-Cylinder Pressure with LabVIEW." National Instruments. Accessed: Jun. 28, 2010. Printed: May 16, 2011. <http://sine.ni.com/cs/app/doc/p/id/cs-217>. pp. 1-2.

Erjavec, Jack. "Automotive Technology: a Systems Approach, vol. 2." Thomson Delmar Learning. Clifton Park, NY. 2005. p. 845.

Hollembeak, Barry. "Automotive Fuels & Emissions." Thomson Delmar Learning. Clifton Park, NY. 2005. p. 298.

InfraTec GmbH. "Evaluation Kit for FPI Detectors | Datasheet—Detector Accessory." 2009. pp. 1-2.

Lewis Research Center. "Fabry-Perot Fiber-Optic Temperature Sensor." NASA Tech Briefs. Published: Jan. 1, 2009. Accessed: May 16, 2011. <http://www.techbriefs.com/content/view/2114/32/>.

Riza et al. "Hybrid Wireless-Wired Optical Sensor for Extreme Temperature Measurement in Next Generation Energy Efficient Gas Turbines." Journal of Engineering for Gas Turbines and Power, vol. 132, Issue 5. May 2010. pp. 051601-1-051601-11.

Ford DIS/EDIS "Waste Spare Ignition System." Accessed: Jul. 15, 2010. Printed: Jun. 8, 2011. <http://rockledge.home.comcast.net/~rockledge/RangerPictureGallery/DIS_EDIS.htm>. pp. 1-6.

"Piston motion equations." Wikipedia, the Free Encyclopedia. Published: Jul. 4, 2010. Accessed: Aug. 7, 2010. Printed: Aug. 7, 2010. <http://en.wikipedia.org/wiki/Dopant>. pp. 1-9.

Riza et al. "All-Silicon Carbide Hybrid Wireless-Wired Optics Temperature Sensor Network Basic Design Engineering for Power Plant Gas Turbines." International Journal of Optomechatronics, vol. 4, Issue 1. Jan. 2010. pp. 1-9.

International Search Report and Written Opinion for Application No. PCT/US2010/059146; Applicant: McAlister Technologies, LLC.; Date of Mailing: Aug. 31, 2011, 11 pages.

INTEGRATED FUEL INJECTOR IGNITERS HAVING FORCE GENERATING ASSEMBLIES FOR INJECTING AND IGNITING FUEL AND ASSOCIATED METHODS OF USE AND MANUFACTURE

CROSS-REFERENCED TO RELATED APPLICATIONS

The present application is a continuation of U.S. patent application Ser. No. 13/347,603, filed Jan. 10, 2012 (now U.S. Pat. No. 8,561,591), which is a continuation of U.S. patent application Ser. No. 12/961,453, filed Dec. 6, 2010 (now U.S. Pat. No. 8,091,528). Each of these applications are incorporated herein by reference in their entirety.

TECHNICAL FIELD

The following disclosure relates generally to fuel injectors suitable for adaptively controlling one or more force generating assemblies for injecting and igniting fuel.

BACKGROUND

Fuel injection systems are typically used to inject a fuel spray into an inlet manifold or a combustion chamber of an engine. Fuel injection systems have become the primary fuel delivery system used in automotive engines, having almost completely replaced carburetors since the late 1980s. Conventional fuel injection systems are typically connected to a pressurized fuel supply, and fuel injectors used in these fuel injection systems generally inject or otherwise release the pressurized fuel into the combustion chamber at a specific time relative to the power stroke of the engine. In many engines, and particularly in large engines, the size of the bore or port through which the fuel injector enters the combustion chamber is small. This small port accordingly limits the size of the components that can be used to actuate or otherwise inject fuel from the injector. Moreover, such engines also generally have crowded intake and exhaust valve train mechanisms, further restricting the space available for components of these fuel injection systems.

DETAILED DESCRIPTION

Figure 1:
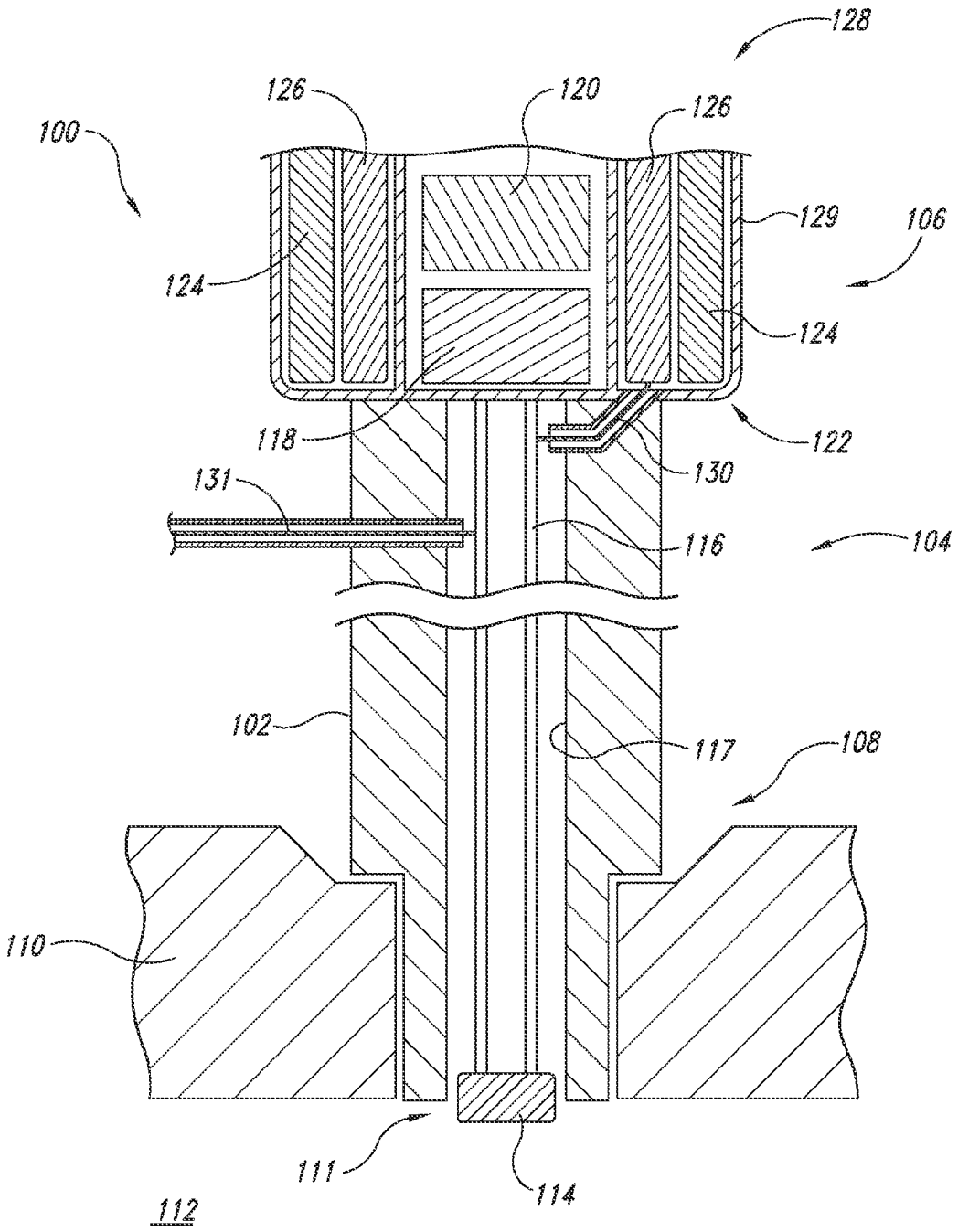
FIG. 1 is a schematic cross-sectional side view of an integrated injector/igniter ("injector") configured in accordance with an embodiment of the disclosure.

The present application incorporates by reference in its entirety the subject matter of the U.S. patent application Ser. No. 12/961,461, filed Dec. 6, 2010, and titled INTEGRATED FUEL INJECTOR IGNITERS CONFIGURED TO INJECT MULTIPLE FUELS AND/OR COOLANTS AND ASSOCIATED METHODS OF USE AND MANUFACTURE.

The present disclosure describes integrated fuel injection and ignition devices for use with internal combustion engines, as well as associated systems, assemblies, components, and methods regarding the same. For example, several of the embodiments described below are directed generally to adaptable fuel injectors/igniters that can vary or otherwise optimize the injection and ignition of various fuels and fluids based on combustion chamber conditions. In certain embodiments, these fuel injectors/igniters include force generating assemblies having two or more force generating components for (a) inducing movement of one or more fuel flow valves to inject fuel into a combustion chamber and (b) initiating an ignition event (e.g., heated filament or plasma initiation) to ignite the fuel in the combustion chamber. In one embodiment, for example, these fuel injectors/igniters can include a first solenoid winding or first piezoelectric component and a second solenoid winding or second piezoelectric component. Certain details are set forth in the following description and in FIGS. 1-2 to provide a thorough understanding of various embodiments of the disclosure. However, other details describing well-known structures and systems often associated with internal combustion engines, injectors, igniters, and/or other aspects of combustion systems are not set forth below to avoid unnecessarily obscuring the description of various embodiments of the disclosure. Thus, it will be appreciated that several of the details set forth below are provided to describe the following embodiments in a manner sufficient to enable a person skilled in the relevant art to make and use the disclosed embodiments. Several of the details and advantages described below, however, may not be necessary to practice certain embodiments of the disclosure.

Many of the details, dimensions, angles, shapes, and other features shown in the Figures are merely illustrative of particular embodiments of the disclosure. Accordingly, other embodiments can have other details, dimensions, angles, and features without departing from the spirit or scope of the present disclosure. In addition, those of ordinary skill in the art will appreciate that further embodiments of the disclosure can be practiced without several of the details described below.

Reference throughout this specification to "one embodiment" or "an embodiment" means that a particular feature, structure, or characteristic described in connection with the embodiment is included in at least one embodiment of the present disclosure. Thus, the occurrences of the phrases "in one embodiment" and "in an embodiment" in various places throughout this specification are not necessarily all referring to the same embodiment. Furthermore, the particular features, structures, or characteristics described with reference to a particular embodiment may be combined in any suitable manner in one or more other embodiments. Moreover, the headings provided herein are for convenience only and do not interpret the scope or meaning of the claimed disclosure.

FIG. 1 is a schematic cross-sectional side view of an integrated injector/igniter 100 ("injector 100") configured in accordance with an embodiment of the disclosure. The injector 100 shown in FIG. 1 is intended to schematically illustrate several of the features of the injectors and assemblies configured in accordance with embodiments of the disclosure. Accordingly, these features described with reference to FIG. 1 are not intended to limit any of the features of the injectors and assemblies described below. As shown in FIG. 1, the injector 100 includes a body 102 having a middle portion 104 extending between a first end portion or base portion 106 and a second end portion or nozzle portion 108. The nozzle portion 108 is configured to at least partially extend through an engine head 110 to inject and ignite fuel at or near an interface 111 with a combustion chamber 112. As described in detail below, the injector 100 is particularly suited to provide adaptive and rapid fuel injection under high fuel delivery pressure, while also providing for rapid ignition and complete combustion in the combustion chamber 112.

The injector 100 also includes an ignition feature 114, such as a conductive electrode, carried by the nozzle portion 108.

The ignition feature 114 is positioned proximate to the interface 111 of the combustion chamber 112 and is configured to ignite fuel flowing through the nozzle portion 108 past the ignition feature 114. The ignition feature 114 is operably coupled to a conductor 116 extending through the body 102. The conductor 116 extends from the nozzle portion 108 through the middle portion 104, and can optionally further extend at least partially into the base portion 106. In certain embodiments, for example, the conductor 116 can extend completely through the base portion 106. As explained in detail below, the conductor 116 is coupled to one or more energy sources that supply ignition energy or voltage. For example, the conductor 116 can be coupled to an energy source at the base portion 106 or at the middle portion 104 of the body 102. Accordingly, the conductor 116 can supply ignition energy to the ignition feature 114 to ignite fuel by a heated filament and/or by direct or alternating plasma current.

The injector 100 further includes a fuel flow valve 118 and a valve operator assembly 128 carried by the base portion. Although the valve 118 is schematically shown in FIG. 1 as being positioned in the base portion 106, in other embodiments the valve can be positioned at other locations within the injector 100, including, for example, at the nozzle portion 108 and/or at the middle portion 104. In addition, in some embodiments the valve 118 can extend through more than one portion of the body 102, including, for example, through the entire body 102. Moreover, although only one valve 118 is illustrated in FIG. 1, in other embodiments the injector 100 can include two or more valves carried by the body 102 at various locations. Furthermore, any of the features of the injector 100 described herein with reference to FIG. 1 can be used in conjunction with any of the injectors described in detail in the patents and patent applications referenced above and otherwise referenced herein, each of which is incorporated by reference in its entirety.

The valve operator assembly 128 is configured to actuate or otherwise move the valve 118 to allow fuel to flow through the body 102 and to introduce the fuel into the combustion chamber 112. More specifically, the valve operator assembly 128 includes a force generator assembly 122 that actuates or otherwise induces movement of a plunger armature or driver 120 (e.g., in one embodiment by generating a magnetic force). The driver 120 is configured to move or otherwise actuate the valve 118. For example, in certain embodiments, the driver 120 can move from a first position to a second position to contact or strike the valve 118 and consequently move the valve 118 from a closed position to an open position. In other embodiments, however, such as when a flow valve is positioned at the nozzle portion 108, the driver 120 can contact or otherwise move an actuator, such as a plunger, rod, or cable that is operably coupled to the valve.

According to additional features of the illustrated embodiment, the force generator assembly 122 can be an electrical, electromechanical, and/or electromagnetic force generator that operates as an electrical transformer. For example, in the illustrated embodiment, the force generator assembly 122 includes a primary or first force generator 124 proximate to a secondary or second force generator 126. Although only two force generators are shown in FIG. 1, in other embodiments the force generator assembly 122 can include more than two separate force generators, including, for example, three or more force generators. In certain embodiments, the first force generator 124 can be a piezoelectric component that can be actuated to provide a force to move the valve 118. In other embodiments, the first force generator 124 can be a solenoid winding. Moreover, the second force generator 126 can also be a piezoelectric component or a solenoid winding. The first solenoid 124 can be coupled to an energy supply source that supplies current (e.g., pulsed or interrupted direct current) to the first solenoid 124. The second solenoid 126 is conductively coupled to the conductor 116 via an electrically insulated solenoid conductor 130. As such, the second solenoid 126 is electrically coupled to the ignition feature 114.

In operation, the force generator assembly 122 accordingly functions as a transformer that provides a motive force for injecting fuel from the injector 100 into the combustion chamber 112. The force generator assembly 122 also provides ignition energy for at least partially initiating ignition of the injected fuel in the combustion chamber 112. For example, when current is applied to the first solenoid 124, the first solenoid 124 generates a force, such as a magnetic force or magnetic flux, which actuates or otherwise moves the driver 120. As the driver 120 moves in response to the first solenoid 124, the driver 120 in turn actuates the valve 118 to inject the fuel into the combustion chamber 112. For example, the driver 120 can directly contact the valve 118 or a valve actuator to move the valve 118 to an open position. Moreover, the magnetic field from the first solenoid 124 induces ignition energy or voltage in the second solenoid 126. Since the second solenoid 126 is electrically coupled to the ignition feature 114 via the conductor 116, the second solenoid 126 can accordingly supply ignition energy (e.g., voltage and/or current) to the ignition feature 114 for at least initiating the ignition of the fuel. In certain embodiments, current can also be supplied to the second solenoid 126 to induce the movement of the driver 120. As such, the second solenoid 126 can accordingly supplement or aid the first solenoid 124 in controlling the movement of the valve 118. In certain embodiments, the first solenoid 124 can be actuated with approximately 10-1,000 volts, and the second solenoid 126 can be induced to provide at least approximately 10,000 volts.

In embodiments where the first and second force generators 124, 126 are solenoid windings, the first solenoid 124 can be in a separate circuit from the second solenoid 126. In another embodiment, however, the first solenoid 124 can be arranged in parallel in a circuit with the second solenoid 126. In other embodiments, the first solenoid 124 can be arranged in series in a circuit with the second solenoid 126. Moreover, the first solenoid 124 can be arranged in the base portion 106 concentrically with the second solenoid 126. Although the first solenoid 124 in FIG. 1 is shown as positioned radially outwardly from the second solenoid 126, in other embodiments the first solenoid 124 can be positioned radially inwardly from the second solenoid 126. In other embodiments, however, the first solenoid 124 and the second solenoid 126 can be positioned or arranged in other configurations, including, for example, non-concentric arrangements for increased packing efficiency within the base portion 106.

According to additional features of embodiments of the force generator assembly 122, including force generators that are solenoid windings, in certain embodiments the winding conductor of the first solenoid 124 can have a cross-sectional dimension (diameter) that is greater than a corresponding cross-sectional dimension (diameter) of the winding conductor of the second solenoid 126 to accommodate a greater current flowing through the first solenoid 124. In one embodiment, for example, the diameter of the winding conductor of the first solenoid 124 can be approximately 10 times greater than the diameter of the winding of the second solenoid 126. In other embodiments, however, the diameter of the winding conductor of the first solenoid 124 can be greater than or less than approximately 10 times the diameter of the winding conductor of the second solenoid 126.

In still further embodiments, since the force generator assembly 122 acts as a transformer, the ratio of the turns or revolutions of the winding conductors of the first solenoid 124 and the second solenoid 126 can be configured to step up or step down the ignition energy or voltage that is induced in the second solenoid 126 to achieve a desired or predetermined induced ignition energy or voltage for supplying the ignition energy. For example, the second solenoid 126 can include a greater number of turns or revolutions of the winding conductor than the first solenoid 124 to step up the induced ignition energy or voltage in the second solenoid 126. In one embodiment, for instance, the second solenoid 126 can include a number of turns or revolutions that is 10 times greater than that of the first solenoid 124. In other embodiments, however, this ratio can be adjusted to achieve any desired induced ignition energy or voltage in the second solenoid 126. In this manner, the second force generator 126 can be configured to generate an ignition event (e.g., initial heating and/or plasma development) with relatively low current applied to the first force generator 124. The winding conductors of the first solenoid 124 and the second solenoid 126 can also be suitably insulated to prevent a short during operation, and particularly in operation at high voltages.

In certain embodiments, the first force generator 124 can include multiple primary solenoid windings. For example, these multiple primary windings can have opposite polarities (e.g., + or −) or different ignition energies or voltages to provide for finer resolution to adjust the movement including the frequency of cyclic motion of the valve 118 and/or the ignition energy or voltage induced in the second force generator 126.

According to additional features of the embodiment illustrated in FIG. 1, the injector 100 can also include an optional ignition energy or voltage supply conductor 131. The voltage supply conductor 131 can be coupled to a suitable ignition energy or voltage source that is separate from the force generator assembly 122, and more particularly, separate from the second solenoid 126. The voltage supply conductor 131 is also electrically coupled to the ignition feature 114 via the conductor 116. As such, the voltage supply conductor 131 can provide ignition energy to the ignition feature 114 to generate an ignition event. Therefore, the voltage supply conductor 131 can provide ignition energy separately from the second solenoid 126, as well as in combination with the second solenoid 126. Although the voltage supply conductor 131 is coupled to the conductor 116 at the middle portion 104 of the body 102, in other embodiments the voltage supply conductor 131 can be coupled to the conductor 116 at the base portion 106 of the body 102.

In the illustrated embodiment, the base portion 106 can also include a plating, casing, or housing 129 at least partially encompassing the force generator assembly 122. The housing 129 can be a metallic housing that provides shielding, such as radio frequency (RF) shielding for the force generator assembly 122. For example, the housing 129 can shield the force generator assembly 122 during operation from other RF devices or sources. The housing 129 can further prevent the force generator assembly 122 from receiving or interfering with other RF devices or sources.

The injector 100 can further include sensors or other instrumentation configured to detect operating conditions. For example, the injector 100 can include fiber optic cables extending at least partially through the body 102 or other sensors positioned in the nozzle portion 108 that are configured to detect combustion chamber properties (as illustrated and described below with reference to sensor instrumentation component 290 of FIG. 2). The valve operator assembly 128 and/or the force generator assembly 122 can accordingly be adaptively controlled in response to one or more combustion chamber conditions.

In operation, fuel is introduced into the base portion 106 and exits the base portion 106 into a fuel flow path or channel 117. The fuel flow channel 117 extends through the body 102 from the base portion 106 through the middle portion 104 to the nozzle portion 108. Precise metered amounts of fuel can be selectively and adaptively introduced through the fuel flow channel 117 into the combustion chamber 112 by the injector 100. For example, the driver 120 actuates the valve 118 to slide, rotate, or otherwise move from a closed position to an open position. The force generator assembly 122 controls the movement of the valve 118. More specifically, the force generator assembly 122 is configured to (1) control fuel flow by opening the valve 118 and/or any other valve assemblies and (2) produce heating and/or ionizing ignition energy or voltage upon completion of the valve opening function. As explained above, to achieve both of these functions, the force generator assembly 122 can be a solenoid winding including a first or primary winding 124 or a first piezoelectric component 124, and a secondary winding 126 or a second piezoelectric component 126. The secondary winding 126 can include more turns than the first winding 124. Each winding can also include one or more layers of insulation (e.g., varnish or other suitable insulators); however, the secondary winding 126 may include more insulating layers than the first winding 124. The force generator assembly 122 can also be electrically coupled to the conductor 116. By winding the force generator assembly 122 or solenoid as a transformer with a primary winding 124 and a secondary winding 126 of many more turns, the primary winding 124 can carry high current upon application of ignition energy or voltage to produce pull or otherwise induce movement of the driver 120 or plunger armature. Upon opening the relay to the primary winding 124, the driver 120 is released and a very high ignition energy or voltage is produced by the secondary winding 126. The high ignition energy or voltage of the secondary winding 126 can be applied to the heating and/or plasma generation ignition event by providing the initial heating and/or ionization to the ignition feature 114 via the conductor 116, after which relatively lower ignition energy or voltage discharge of a capacitor carried by the injector 100 that has been charged with any suitable source (including energy harvested from the combustion chamber by photovoltaic, thermoelectric, and piezoelectric generators) continues to supply ionizing current and thrust of fuel into the combustion chamber 112.

Furthermore, in operation the injector 100 can adapt injection and ignition, or otherwise be controlled according to the energy required to initiate ignition and complete combustion for fuels with different energy densities and/or ignition characteristics. For example, less ignition energy may be required for hydrogen-characterized fuels that are easier to ignite than, for instance, diesel fuels having a greater ignition energy requirement. In such cases, the ignition energy may be provided solely by the second force generator 126. In embodiments requiring greater ignition energy, however, the second force generator 126 can provide the increased energy alone or in combination with a second energy source coupled to the conductor 116 via the voltage supply conductor 131. Although examples of hydrogen and diesel fuels are given above, one of ordinary skill in the art will appreciate that embodiments of the present disclosure can be used with numerous different fuels, including at least hydrogen- and/or diesel-characterized fuels.

The injector 100 also provides for several scenarios of using harvested energy in operation to at least partially aid in injecting and igniting the fuel. For example, when the first force generator 124 induces movement of the driver 120, the second force generator 126 harvests energy from the first force generator 124 as the ignition energy is induced in the second force generator 126. Moreover, energy from the second force generator 126 can be applied to actuate a piezoelectric component to actuate the valve 118. The injector 100 can further use energy harvested from the combustion chamber 112 (e.g., energy stored in a capacitor) to initiate and/or sustain the ignition event. For example, light energy, pressure energy, thermal energy, acoustical energy, vibration, and/or other types of energy can be used to initiate and sustain the fuel ignition event.

Figure 2:
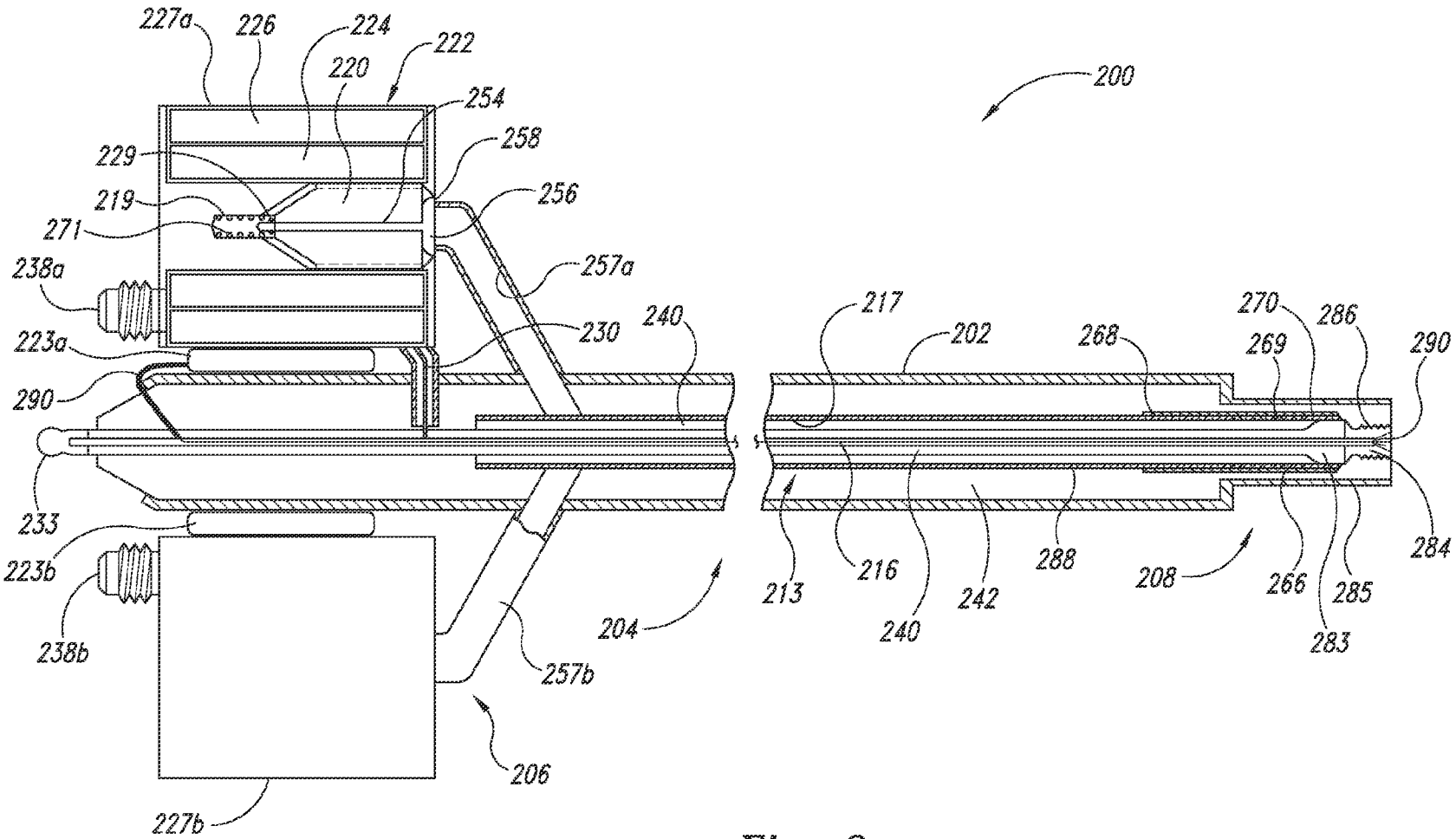
FIG. 2 is a cross-sectional side view of an injector configured in accordance with another embodiment of the disclosure.

FIG. 2 is a cross-sectional side view of an integrated injector/igniter 200 ("injector 200") configured in accordance with yet another embodiment of the disclosure. The injector 200 illustrated in FIG. 2 includes several features that are generally similar in structure and function to the corresponding features of the injector 100 described above with reference to FIG. 1. For example, as shown in FIG. 2, the injector 200 includes a body 202 having a middle portion 204 extending between a first or base portion 206 and a second or nozzle portion 208. The nozzle portion 208 is configured to extend into an injection port in a cylinder head.

The injector 200 further includes one or more base assemblies 227 (identified individually as a first base assembly 227*a* and a second base assembly 227*b*) configured to receive fuel into the base portion 206 of the injector 200 and selectively meter the fuel to the nozzle portion 208, as well as to provide ignition energy to the nozzle portion 208. More specifically, each base assembly 227 includes a force generator assembly 222 configured to actuate a corresponding poppet or base valve 254, as well as to provide ignition energy to a corresponding conductor 216 extending through the body 202. More specifically, the force generator assembly 222 includes at least a first force generator 224 (e.g., at least one solenoid winding or piezoelectric component) as well as a second force generator 226 (e.g., at least one solenoid winding or piezoelectric component). Similar to the force generator assembly 122 described above with reference to FIG. 1, the force generator assembly 222 in FIG. 2 is configured to (1) control fuel flow by opening any of the valve assemblies and (2) produce heating and/or ionizing ignition energy or voltage upon completion of the valve opening function. To achieve both of these functions, in certain embodiments, the force generator assembly 222 can include the first force generator 224 that is a first or primary solenoid winding, and the second force generator 226 that is a secondary solenoid winding. The force generator assembly 222, and specifically the secondary solenoid winding 226, can be coupled to the conductor 216 via a voltage supply conductor 230. The secondary winding 226 can include more turns than the first winding 224. Each of the first and secondary windings 224, 226 can also include one or more layers of insulation (e.g., varnish or other suitable insulators); however, the secondary winding 226 may include more insulating layers than the first winding 224. The force generator assembly 222 can also be electrically coupled to the conductor 216. By configuring the force generator assembly 222 as a transformer with a primary winding 224 and a secondary winding 226 of many more turns, the primary winding 224 can carry high current upon application of ignition energy or voltage to produce pull or otherwise induce movement of a valve actuating driver or plunger armature. Upon opening the relay to the primary winding 224, the valve actuating driver is released and a very high ignition energy or voltage is produced by the secondary winding 226. The high ignition energy or voltage of the secondary winding 226 can be applied to the heating and/or plasma generation ignition event such as by providing the initial ionization after which relatively lower ignition energy or voltage discharge of a capacitor that has been charged with any suitable source (including energy harvested from the combustion chamber by photovoltaic, thermoelectric, and piezoelectric generators) continues to supply ionizing current and thrust of fuel into the combustion chamber.

As noted above, the force generator assembly 222 induces movement of a driver 220. The force generator assembly 222 can also be operably coupled to a corresponding controller or processor 223 (identified individually a first controller 223*a* and a second controller 223*b*) to selectively pulse or actuate the force generator assembly 222, for example, in response to one or more combustion chamber conditions or other engine parameters. The driver 220 engages a first check valve or base valve 254 at the base portion 206. More specifically, the base valve 254 includes one or more stops 229 that engage a biasing member 271 (e.g., a coil spring or magnet) positioned in a biasing member cavity 219 to bias the base valve 254 toward a closed position as shown in FIG. 2 (e.g., in a direction toward the nozzle portion 208). The base valve stop 229 also engages the driver 220 such that the driver 220 moves the base valve 254 between the open and closed positions. The base valve 254 also includes a base valve head or sealing portion 256 that engages a corresponding valve seat 258 in the normally closed position as shown.

The injector 200 also includes a fuel inlet fitting 238 (identified individually as a first fuel inlet fitting 238*a* and a second fuel inlet fitting 238*b*) operably coupled to the corresponding base assembly 227 to introduce the fuel into the respective base assembly 227. In each base assembly 227, the fuel flows through the force generator assembly 222 and the driver 220 to move past the base valve head 256 when the base valve 254 is in the open position. The injector 200 further includes fuel connecting conduits 257 (identified individually as a first fuel connecting conduit 257*a* and a second fuel connecting conduit 257*b*) to transport the fuel from the base portion 206 to a fuel flow path or channel 217 extending through the middle portion 204 and the nozzle portion 208 of the body 202. The fuel flow channel 217 extends longitudinally adjacent to a core assembly 213, which extends through the body 202 from the base portion 206 at least partially into the nozzle portion 208. The core assembly 213 includes a core insulator 240 coaxially disposed over an ignition member or conductor 216. The core assembly 213 also includes a cylindrical or tubular enclosure member 288 that at least partially defines the fuel flow channel 217 with the ignition insulator 240. The core assembly 213 extends through an insulative body 242 of the body 202. The ignition conductor 216 is operably coupled to an ignition terminal 233 to supply an ignition energy or voltage (in addition to ignition voltage or energy from the force generator assembly 222) to an ignition electrode 284 that may have one or more ignition features 286. The ignition electrode 284 is a first electrode that can generate ignition events with a second electrode 285, which can be a conductive portion of the distal end of the nozzle portion 208, or it can be a suitable proximate portion of the cylinder head port. The ignition insulator 240 includes an enlarged end portion 283 that may have a greater cross-sectional dimension (e.g., a greater cross-sectional diameter) adjacent to the ignition electrode 284.

The enlarged end portion 283 of the ignition insulator 240 is configured to contact a flow control valve 266 carried by the nozzle portion 208. The flow valve 266 is a radially expanding valve that includes a first or stationary end portion 268 that is anchored, adhered, or otherwise coupled to the enclosure member 288 at a location upstream from the enlarged end portion 283 of the ignition insulator 240. For example, the first end portion 268 can be adhered to an outer surface of the enclosure member 288 with a suitable adhesive, thermopolymer, thermosetting compound, or other suitable adhesive or anchoring provision. The flow valve 266 further includes a second deformable or movable end portion 270 opposite the first stationary end portion 268. The movable end portion 270 contacts the enlarged end portion 283 of the ignition insulator 240 and is configured to at least partially radially open, expand, enlarge, or otherwise deform to allow fuel to exit the nozzle portion 208 of the injector 200. More specifically, the enclosure member 288 includes multiple fuel exit ports 269 adjacent to the movable end portion 270 of the flow valve 266.

During operation, fuel is introduced into the base assembly 227 via the fuel inlet fitting 238. The fuel flows through the force generator assembly 222 and suitable passageways through the driver 220 to arrive at the base valve head 256. For example, the driver 220 can include one or more fuel passageways extending adjacent to an outer periphery or diameter of the driver 220 as shown in broken lines in FIG. 2. When the force generator assembly 222 (and more specifically, the first solenoid winding 224 or piezoelectric component 224) moves the base valve 254 to the open position to space the base valve head 256 apart from the valve seat 258, the fuel flows past the base valve head 256 and into the fuel connecting conduits 257. From the fuel connecting conduits 257, the pressurized fuel flows into the fuel flow channel 217. In one embodiment, the pressure of the fuel in the fuel flow channel 217 is sufficient to open, expand, or deform the movable end portion 270 of the flow valve 266 radially outwardly to allow the fuel to flow past the enlarged end portion 283 of the ignition insulator 240. In other embodiments, however, one or more actuators, drivers, selective biasing members, or other suitable force generators can at least partially radially open, expand, or otherwise deform the movable end portion 270 of the flow valve 266. As the flow valve 266 selectively dispenses the fuel from the fuel exit ports 269, the fuel flows past the one or more ignition features 286 that can generate an ignition event to ignite and inject the fuel into the combustion chamber. The force generator assembly 222, and more specifically, the second solenoid winding 226 or piezoelectric component, can provide at least the initial ionization or ignition energy to the ignition feature 284 via the voltage supply connector 230 and the conductor 216. The ignition terminal 233 can further supplement or otherwise supply ionization or ignition energy to the ignition feature 284 via the conductor 216. Moreover, ignition energy can also be provided by the relatively greater or lower ignition energy or voltage discharge of a capacitor that has been charged with any suitable source (including energy harvested from the combustion chamber by photovoltaic, thermoelectric, and piezoelectric generators) to continue to supply ionizing current and thrust of fuel into the combustion chamber.

An injector configured in accordance with an embodiment of the disclosure can in include an injector body having a base portion configured to receive fuel into the body, and a nozzle portion coupled to the base portion. The nozzle portion is configured to be positioned proximate to the combustion chamber for injecting fuel into the combustion chamber. The injector also includes an ignition feature at the nozzle portion and configured to generate an ignition event to at least partially ignite fuel, a valve carried by the body, wherein the valve is movable to an open position to introduce fuel into the combustion chamber, and a force generator assembly carried by the base portion. The force generator assembly includes a valve driver carried by the base portion, and a force generator carried by the base portion and configured to actuate the valve driver. The valve driver is movable between a first position and a second position, and the force generator includes a first solenoid winding or a configured to generate a magnetic field, and a second solenoid winding separate from the first solenoid winding and electrically coupled to the ignition feature. The magnetic field moves the valve driver from the first position to the second position to move the valve to the open position. The magnetic field also generates ignition energy in the second solenoid. Moreover, the second solenoid supplies the ignition energy to the ignition feature to at least partially initiate the ignition event.

In certain embodiments, the first solenoid winding is in parallel in a circuit with the second solenoid winding. In other embodiments, however, the first solenoid winding is in series in a circuit with the second solenoid winding. Moreover, the first solenoid winding can be concentric with the second solenoid winding, or the first solenoid winding may not be concentric with the second solenoid winding. The injector can further include a fuel inlet fluidly coupled to the force generator assembly to introduce fuel into the base portion via the force generator assembly. In addition, the second ignition energy source is a capacitor carried by the injector body, and the second motive force moves the valve only from the open position to the closed position. Moreover, the valve driver can be at least partially made from a ferromagnetic material, and the motive force can be a magnetic force generated by the first force generator.

A method of operating a fuel injector to inject fuel into a combustion chamber and at least partially ignite the fuel according to embodiments of the disclosure comprises introducing at least one of fuel or coolant into a body of the fuel injector, actuating a valve with a first force generator to dispense the fuel from the body into the combustion chamber; and activating an ignition feature with a second force generator electrically coupled to the ignition feature, wherein the second force generator is adjacent to the first force generator. The second force generator can provide electrical inducement coupling with the first force generator.

The present application incorporates by reference in its entirety the subject matter of the following applications: U.S. Provisional Application No. 61/237,466, filed Aug. 27, 2009 and titled MULTIFUEL MULTIBURST; U.S. Provisional Patent Application No. 61/407,437, filed Oct. 27, 2010 and titled FUEL INJECTOR SUITABLE FOR INJECTING A PLURALITY OF DIFFERENT FUELS INTO A COMBUSTION; U.S. Provisional Application No. 61/304,403, filed Feb. 13, 2010 and titled FULL SPECTRUM ENERGY AND RESOURCE INDEPENDENCE; U.S. Provisional Application No. 61/312,100, filed Mar. 9, 2010 and titled SYSTEM AND METHOD FOR PROVIDING HIGH VOLTAGE RF SHIELDING, FOR EXAMPLE, FOR USE WITH A FUEL INJECTOR; U.S. Provisional Application No. 61/237,425, filed Aug. 27, 2009 and titled OXYGENATED FUEL PRODUCTION; U.S. Provisional Application No. 61/237,479, filed Aug. 27, 2009 and titled FULL SPECTRUM ENERGY; U.S. patent application Ser. No. 12/841,170, filed Jul. 21, 2010 and titled INTEGRATED FUEL INJECTORS AND IGNITERS AND ASSOCIATED METHODS OF USE AND MANUFACTURE; U.S. patent application Ser. No. 12/804,510, filed Jul. 21, 2010 and titled FUEL INJECTOR ACTUATOR ASSEMBLIES AND ASSOCIATED METHODS OF USE AND MANUFACTURE; U.S. patent application Ser. No. 12/841,146, filed Jul. 21, 2010 and titled INTEGRATED FUEL INJECTOR IGNITERS WITH CONDUCTIVE CABLE ASSEMBLIES; U.S. patent application Ser. No. 12/841,149, filed Jul. 21, 2010 and titled SHAPING A FUEL CHARGE IN A COMBUSTION CHAMBER WITH MULTIPLE DRIVERS AND/OR IONIZATION CONTROL; U.S. patent application Ser. No. 12/841,135, filed Jul. 21, 2010 and titled CERAMIC INSULATOR AND METHODS OF USE AND MANUFACTURE THEREOF; U.S. patent application Ser. No. 12/804,509, filed Jul. 21, 2010 and titled METHOD AND SYSTEM OF THERMOCHEMICAL REGENERATION TO PROVIDE OXYGENATED FUEL, FOR EXAMPLE, WITH FUEL-COOLED FUEL INJECTORS; U.S. patent application Ser. No. 12/804,508, filed Jul. 21, 2010 and titled METHODS AND SYSTEMS FOR REDUCING THE FORMATION OF OXIDES OF NITROGEN DURING COMBUSTION IN ENGINES; U.S. patent application Ser. No. 12/581,825, filed Oct. 19, 2009 and titled MULTIFUEL STORAGE, METERING AND IGNITION SYSTEM; U.S. patent application Ser. No. 12/653,085, filed Dec. 7, 2009 and titled INTEGRATED FUEL INJECTORS AND IGNITERS AND ASSOCIATED METHODS OF USE AND MANUFACTURE; U.S. patent application Ser. No. 12/006,774 (now U.S. Pat. No. 7,628,137), filed Jan. 7, 2008 and titled MULTIFUEL STORAGE, METERING AND IGNITION SYSTEM; U.S. patent application Ser. No. 12/913,749, filed Oct. 27, 2010 and titled ADAPTIVE CONTROL SYSTEM FOR FUEL INJECTORS AND IGNITERS; PCT Application No. PCT/US09/67044, filed Dec. 7, 2009 and titled INTEGRATED FUEL INJECTORS AND IGNITERS AND ASSOCIATED METHODS OF USE AND MANUFACTURE; and U.S. patent application Ser. No. 12/961,461, filed Dec. 6, 2010 and titled: INTEGRATED FUEL INJECTOR IGNITERS CONFIGURED TO INJECT MULTIPLE FUELS AND/OR COOLANTS AND ASSOCIATED METHODS OF USE AND MANUFACTURE.

From the foregoing, it will be appreciated that specific embodiments of the disclosure have been described herein for purposes of illustration, but that various modifications may be made without deviating from the spirit and scope of the invention. For example, the force generating assemblies described herein can include more than two force generating components (e.g., more than two solenoid windings or piezoelectric components). Moreover, components of the injector may be varied, including, for example, the electrodes, the optics, the actuators, the valves, the nozzles, and/or the bodies may be made from alternative materials or may include alternative configurations than those shown and described and still be within the spirit of the disclosure.

Unless the context clearly requires otherwise, throughout the description and the claims, the words "comprise," "comprising," and the like are to be construed in an inclusive sense as opposed to an exclusive or exhaustive sense, that is to say, in a sense of "including, but not limited to." Words using the singular or plural number also include the plural or singular number, respectively. When the claims use the word "or" in reference to a list of two or more items, that word covers all of the following interpretations of the word: any of the items in the list, all of the items in the list, and any combination of the items in the list. In addition, the various embodiments described above can be combined to provide further embodiments. All of the U.S. patents, U.S. patent application publications, U.S. patent applications, foreign patents, foreign patent applications, and non-patent publications referred to in this specification and/or listed in the Application Data Sheet are incorporated herein by reference, in their entirety. Aspects of the disclosure can be modified, if necessary, to employ fuel injectors and ignition devices with various configurations, and concepts of the various patents, applications, and publications to provide yet further embodiments of the disclosure.

These and other changes can be made to the disclosure in light of the above-detailed description. In general, in the following claims, the terms used should not be construed to limit the disclosure to the specific embodiments disclosed in the specification and the claims, but should be construed to include all systems and methods that operate in accordance with the claims. Accordingly, the invention is not limited by the disclosure, but instead its scope is to be determined broadly by the following claims.

I claim:

1. An injector igniter for replacing a diesel fuel injector in an internal combustion engine, the injector igniter comprising:

a valve movable between a closed position and an open position to introduce fuel into a combustion chamber of the internal combustion engine;

an ignition feature positioned to generate an ignition event;

a valve driver movable between a first position and a second position;

a first solenoid winding configured to generate a magnetic field, wherein the magnetic field moves the valve driver from the first position to the second position to move the valve from the closed position to the open position; and a second solenoid winding, separate from the first solenoid winding, wherein the second solenoid winding is electrically coupled to the ignition feature, wherein the magnetic field generates ignition energy in the second solenoid winding, and wherein the second solenoid winding supplies the ignition energy to the ignition feature to generate the ignition event.

2. The injector igniter of claim 1 wherein the first solenoid winding includes a first number of windings and the second solenoid winding includes a second number of windings, wherein the second number of windings is at least five times greater than the first number of windings, and wherein the ignition event includes the generation of a plasma.

3. The injector igniter of claim 1 wherein the first solenoid winding includes a first conductor having a first diameter, wherein the second solenoid winding includes a second conductor having a second diameter, and wherein the first diameter is at least five times greater than the second diameter.

4. The injector igniter of claim 1, further comprising a voltage supply conductor electrically coupled to the ignition feature, wherein the voltage supply conductor and the second solenoid winding supply ignition energy to the ignition feature to generate the ignition event.

5. The injector igniter of claim 1, further comprising a capacitor electrically coupled to the ignition feature, wherein the capacitor and the second solenoid winding supply ignition energy to the ignition feature to generate the ignition event.

6. The injector igniter of claim 1 wherein the valve is a first valve, wherein the injector igniter further includes a second valve, the second valve comprising a radially expandable flow valve, wherein operation of the first valve to the open position directs the fuel towards the second valve, and wherein fuel pressure deforms the second valve to an open position to introduce the fuel into the combustion chamber.

7. The injector igniter of claim 1, further comprising:

an ignition conductor, wherein the ignition conductor electrically couples the second solenoid winding to the ignition feature; and a core insulator coaxially disposed over the ignition conductor.

8. An injector igniter comprising:

an injector body positionable at least partially within an injector port in an internal combustion engine;

a valve positioned at least partially within the injector body and operable between a closed position and an open position;

an electrode positioned to produce an ignition event;

a valve driver movable to operate the valve between the closed position and the open position;

a first solenoid positioned to produce a magnetic field that moves the driver to operate the valve and inject fuel into a combustion chamber of the internal combustion engine; and a second solenoid electrically coupled to the electrode to provide electrical current to the electrode to produce the ignition event, wherein the electrical current is generated via the magnetic field.

9. The injector igniter of claim 8 wherein the valve is a first valve, wherein the injector igniter further comprises a second valve positioned proximate the electrode, and wherein the second valve is radially expandable to release the fuel into the combustion chamber.

10. The injector igniter of claim 8, further comprising a capacitor electrically coupled to the electrode, wherein the capacitor provides ionizing current to the electrode.

11. The injector igniter of claim 8 wherein the first solenoid includes a first conductor having a first diameter, and the second solenoid includes a second conductor having a second diameter, different than the first diameter.

12. The injector igniter of claim 11 wherein the first diameter is approximately ten times greater than the second diameter.

13. The injector igniter of claim 8 wherein the second solenoid is electrically coupled to the electrode via an ignition conductor that extends through a majority of an axial length of the injector body.

14. The injector igniter of claim 13, further comprising a core insulator coaxially disposed over the ignition conductor.

15. A method for injecting and igniting fuel in an internal combustion engine, the method comprising:

introducing fuel into an injector igniter;

providing a first electrical current to a first solenoid to generate a magnetic field;

moving a driver from a first position to a second position via the magnetic field;

moving a valve from a closed position to an open position via the movement of the driver from the first position to the second position, wherein movement of the valve from the closed position to the open position injects the fuel into a combustion chamber of the internal combustion engine;

generating a second electrical current in a second solenoid via the magnetic field; and transmitting the second electrical current to an electrode to ignite the fuel.

16. The method of claim 15 wherein transmitting the current to an electrode includes transmitting the current via an ignition conductor positioned coaxially within a core insulator.

17. The method of claim 15 wherein the first electrical current is produced at a first voltage, and wherein the second electrical current is generated at a second voltage, greater than the first.

18. The method of claim 15 wherein the valve is a first valve, and wherein movement of the valve from the closed position to the open position injects the fuel into the combustion chamber via radial deformation of a second valve.

19. The method of claim 15 wherein transmitting the second electrical current to an electrode to ignite the fuel includes generating a plasma via the second electrical current.

20. The method of claim 15, further comprising transmitting a third electrical current from a capacitor to the electrode.

* * * * *